US006435140B1

(12) United States Patent
Joyce

(10) Patent No.: US 6,435,140 B1
(45) Date of Patent: Aug. 20, 2002

(54) GAS-FIRED HEATERS WITH BURNERS HAVING A SUBSTANTIALLY SEALED COMBUSTION CHAMBER

(75) Inventor: John V. Joyce, NSW (AU)

(73) Assignee: Bowin Technology Pty Limited, Brookvale (AU)

( * ) Notice: Subject to any disclaimer, the term of this patent is extended or adjusted under 35 U.S.C. 154(b) by 0 days.

(21) Appl. No.: 09/824,948

(22) Filed: Apr. 3, 2001

(51) Int. Cl.[7] ..... F22B 7/00

(52) U.S. Cl. ..... 122/13.01; 122/17.1; 122/18.31; 122/504

(58) Field of Search ..... 122/13.01, 17.1, 122/17.2, 18.31, 504

(56) References Cited

U.S. PATENT DOCUMENTS

| | | | | |
|---|---|---|---|---|
| 5,317,992 A | | 6/1994 | Joyce | 122/14 |
| 5,435,716 A | | 7/1995 | Joyce | 431/7 |
| 6,295,951 B1 | * | 10/2001 | Valcic et al. | 122/13.01 |

* cited by examiner

*Primary Examiner*—Jiping Lu
(74) *Attorney, Agent, or Firm*—Pearne & Gordon LLP

(57) ABSTRACT

A gas-fired combustion apparatus includes a burner disposed in a substantially sealed combustion chamber and a permeable flexible member arranged to suppress pressure fluctuations within the combustion chamber while concurrently providing for intake of combustion air and restriction of particulate which may interfere with burner operation and increase the risk of ignition of flammable vapor remote of the combustion chamber. The permeable flexible member forms a portion of the combustion chamber wall and is displaceable to provide volume changes. Water heater applications of the burner apparatus are illustrated.

31 Claims, 4 Drawing Sheets

FIG. 2
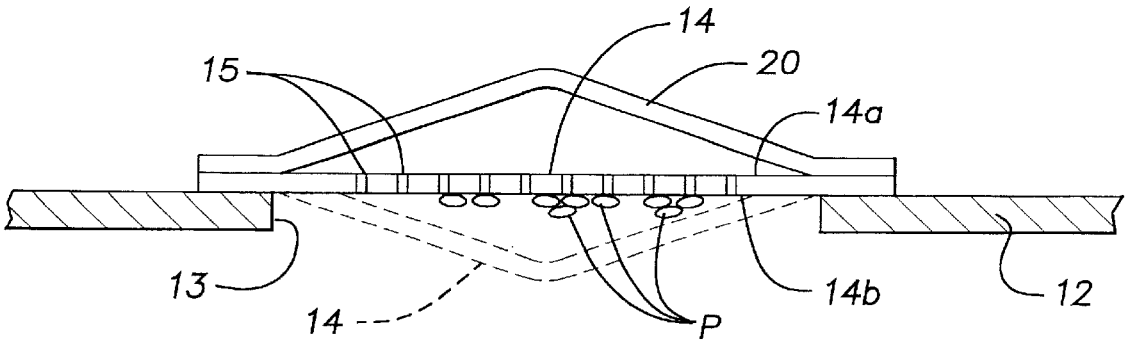
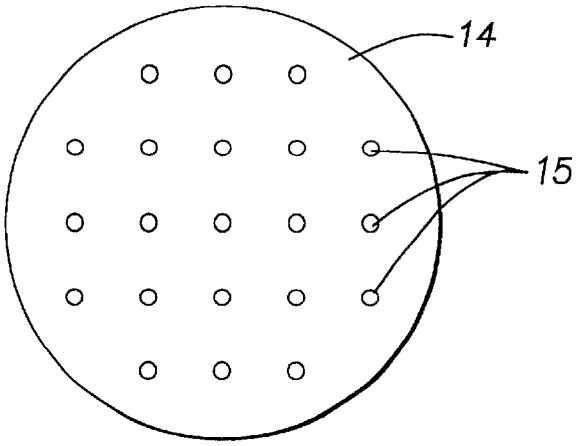
FIG. 3

GAS-FIRED HEATERS WITH BURNERS HAVING A SUBSTANTIALLY SEALED COMBUSTION CHAMBER

FIELD OF INVENTION

The present invention relates to gas-fired apparatus, and more particularly, to gas-fired heaters, in which combustion occurs within a sealed or substantially sealed combustion chamber. A gas flow device and method provide regulation of gaseous and/or particulate flows in respect to the combustion chamber. In an illustrated embodiment, the gas flow device provides in-take of ambient air for use as primary or secondary air during combustion with suppression of low frequency start-up vibrations and effective filtration of airborne particulate.

BACKGROUND OF INVENTION AND RELATED ART

The present invention is particularly advantageous in connection with gas-fired heaters having a sealed combustion chamber and a burner that is supplied with a combustible fuel such as natural gas and combustion air from the surrounding environment. The invention is illustrated and described hereafter with respect to residential hot water heaters.

In such water heaters, the burner may comprise a porous surface burner such as an infrared burner or a blue flame burner. In the former, the primary air flow may exceed the stoichiometric ratio and no secondary air is required to complete combustion of the fuel. In the case of a blue flame burner, secondary air is generally required to complete the combustion process. In both cases, the primary or secondary air may be delivered to the burner after passing through an entrance opening in the sealed combustion chamber.

One problem encountered in connection with the operation of the foregoing heaters is the occurrence of low frequency resonant vibrations in the range of 1–100 hertz during combustion start-up. Such low frequency vibrations or noise may be suppressed by relieving pressure buildup in the combustion chamber. Such pressure relief may be provided by combustion chamber volume change or pressure relief as taught in U.S. Pat. No. 5,435,716 owned by the assignee of the present application.

As discussed in greater detail in U.S. Pat. No. 5,435,716, it is theorized that when a gas-fired heater is first placed into operation and the burner is lit there is an initial rapid expansion of the air/gas mixture in the combustion chamber. The expansion occurs so rapidly that the inertia of the column of air in the flue pipe or exhaust pipe open to the atmosphere is unable to accelerate fast enough to remove all of the expanding gases. As a result the pressure in the combustion chamber increases during a high pressure start-up cycle and restricts the flow of combustion air or an air/fuel mixture to the burner so as to inhibit combustion as well as the formation of combustion products and commence a low pressure start-up cycle. The increase in pressure in the combustion chamber may in fact cause the combustion air or air/fuel mixture to flow backwards. This causes the burner flame to greatly decrease in intensity and may even force the flame to extinguish. Once the hot combustion gases in the combustion chamber have had sufficient time to overcome the inertia of the gases in the flue pipe, they will have moved up the flue pipe, causing the low pressure cycle to exist in the combustion chamber. The low pressure cycle or vacuum created will rapidly draw in the combustion air or air/fuel mixture causing rapid expansion of the flame and the hot gases will result in a pressure increase, thereby starting the high pressure cycle over again.

The pressure relief device allows for the increase of pressure in the combustion chamber caused by the inertia of the air in the flue pipe or exhaust pipe to be relieved and not restrict the flow of the combustion air or air/fuel mixture, thereby greatly reducing or completely eliminating the noise that the hot water heater makes when engaged, and inhibiting non-uniform flow. Thereafter, there exists little fluctuation in the pressure in the combustion chamber and generally uniform combustion follows.

As described above the fluctuation in air pressure causes a low resonance frequency to be observed. The low resonance frequency is best characterized as a rumbling. Although over an extensive period of time the low resonance frequency will dissipate, most gas-fired heaters are not in continuous operation, and the resonance frequency occurs each time the burner is placed into operation.

Another problem often encountered in connection with the operation of the foregoing heaters is burner intake of flammable or ignitable vapor contained in the ambient air supply. The intake of such flammable vapor may result in an explosion and/or ignition of the vapor portions remote of the heater. Such explosion and/or remote ignition may be associated with a pilot light used in connection with the heater or the intermittent operation of the heater burner itself.

The vapor may result from any number of volatile liquid or gaseous sources such as gasoline, solvents, insecticides, propane and other such sources typically encountered at the sites of household heater applications. The obvious resolution of this problem is to pass the intake ambient air together with any flammable vapor contained therein through a flame trap or arrester. Such flame traps are well-known in the art and tend to contain combustion of the flammable vapor within the sealed combustion chamber.

However, the use of a flame trap is not entirety satisfactory since the ambient air also tends to contain particulate which may collect and block the passage of flammable vapor through the flame trap. Illustrative particulate includes lint from fabrics or the like, dust and other conventional solid contaminants found in household or residential ambient air. If particulate collection is sufficient to block gas flow through the flame trap, the burner combustion may be interrupted. On the other hand, if the particulate is combustible, it may serve as a wick or flame path to ignite flammable vapors outside the combustion chamber.

A related problem described in U.S. Pat. No. 5,317,992, which is also owned by the assignee herein, arises when it is necessary to achieve high burner loading in a relatively small space. In such cases, maintaining low $NO_x$ emissions becomes even more difficult as increased loading tends to increase the combustion temperature and carbon monoxide and $NO_x$ concentrations in the products of combustion. Substantially sealing the combustion chamber overcomes this tendency by causing a subatmospheric pressure condition in the combustion chamber sufficient to pull excess primary air through the burner to cool the flame and reduce the emissions of carbon monoxide and $NO_x$ to low levels. However, substantially sealing the combustion chamber also exacerbates the tendency of burners operating in combustion chambers to produce a resonance or combustion noise upon ignition of combustion. This resonance can persist for long times and can be unacceptably loud. The tighter the seal, the louder the noise, and the more difficult it becomes to control it.

It is the object of the present invention to overcome or minimize the disadvantages of the existing technology as described above. Such disadvantages specifically include the low resonance frequency noise observed when the gas-fired heater is initially placed into operation, the risk of explosion and/or ignition of flammable vapor that may be contained in ambient air and the avoidance of interference of burner operation by airborne particulate.

SUMMARY OF THE INVENTION

As indicated, the present invention contemplates a device and method for accommodating or suppressing pressure fluctuations within a sealed or substantially sealed enclosure or combustion chamber while concurrently providing for intake of combustion air. Further, the device and method may be arranged to provide regulation of the risks of particulate interference with burner operation and flammable vapor ignition.

Specifically, a gas-fired combustion apparatus or heater having a sealed or substantially sealed enclosure or combustion chamber includes a pressure relief device that operates to relieve or suppress pressure changes which may otherwise occur in the combustion chamber with commencement of the burner operation. To that end, ambient air enters the combustion chamber through a gas flow device arranged to pass ambient air for use in the combustion process and restrict particulate flow which may interfere with the combustion process and/or serve as a flame path to ignite flammable vapor remote of the combustion chamber. The particulate is concomitantly cleared from the gas flow device by the latter's operation to relieve or suppress pressure fluctuations in the combustion chamber.

In an illustrated embodiment, the gas flow device comprises a flexible member extending across the entrance to the combustion chamber. The flexible member is gas permeable to allow passage of ambient air into the combustion chamber while restricting the entrance of particulate such as lint or dust. The flexible member is fixed about its periphery to the combustion chamber. The flexible member is sufficiently elastic to deform and oscillate or reciprocally move in the manner of a drum skin in response to pressure fluctuations. In this manner, the flexible member provides both volume changes and venting of gas from the interior of the combustion chamber in order to reduce the low frequency vibrations.

The pulsing oscillations or reciprocal movement of the flexible member tends to dislodge particulate collected on the surface of the flexible member remote of the combustion chamber. That is, the particulate falls away from the surface of the flexible member and back into the environment.

The flexible member may be formed of any suitable extensible material. The extensible material may be formed of polymers, woven or nonwoven fibrous webs and combinations thereof. As used herein, extensible contemplates a degree of elastic deformation sufficient to accommodate the oscillations of the flexible member.

If the material does not have sufficient permeability for the desired gas flow, openings may be provided in the member. Illustrated materials include synthetic and natural rubbers, silicone polymers, urethane polymers and fluoride polymers as are well-known in the art.

It should be appreciated that the overall size, thickness and degree of permeability or opening sizes of the flexible member together with the modulus properties of the material forming the member cooperatively provide sufficient movement of the member in response to pressure fluctuations to achieve the desired pressure relief. In addition to pressure relief, sufficient movement of the flexible member is provided to shake free particulate collected on the surface of the member remote of the combustion chamber.

The foregoing regulation of particulate permits the safe use of a flame trap located downstream of the flexible member to receive the incoming ambient air. The incoming ambient air flows through the flame trap in order for the latter to quench flame propagation to the exterior of the combustion chamber. Suitable flame traps or flame arresters are well-known in the art and typically include a heat resistant permeable material.

Flame traps typically include one or more woven or mesh screens formed of metal. Suitable metals include woven stainless-steel, inconel 601 wire mesh or the like. The flame trap may also be formed of a porous ceramic element such as a SCHWANK type ceramic tile.

BRIEF DESCRIPTION OF THE DRAWINGS

FIG. 2 is a schematic fragmentary sectional view on an enlarged scale of the gas flow device and a flame trap taken along dashed line A in FIG. 1;

FIG. 3 is a schematic plan view of the gas flow device shown in FIG. 1;

DETAILED DESCRIPTION OF THE PREFERRED EMBODIMENT

Figure 1:
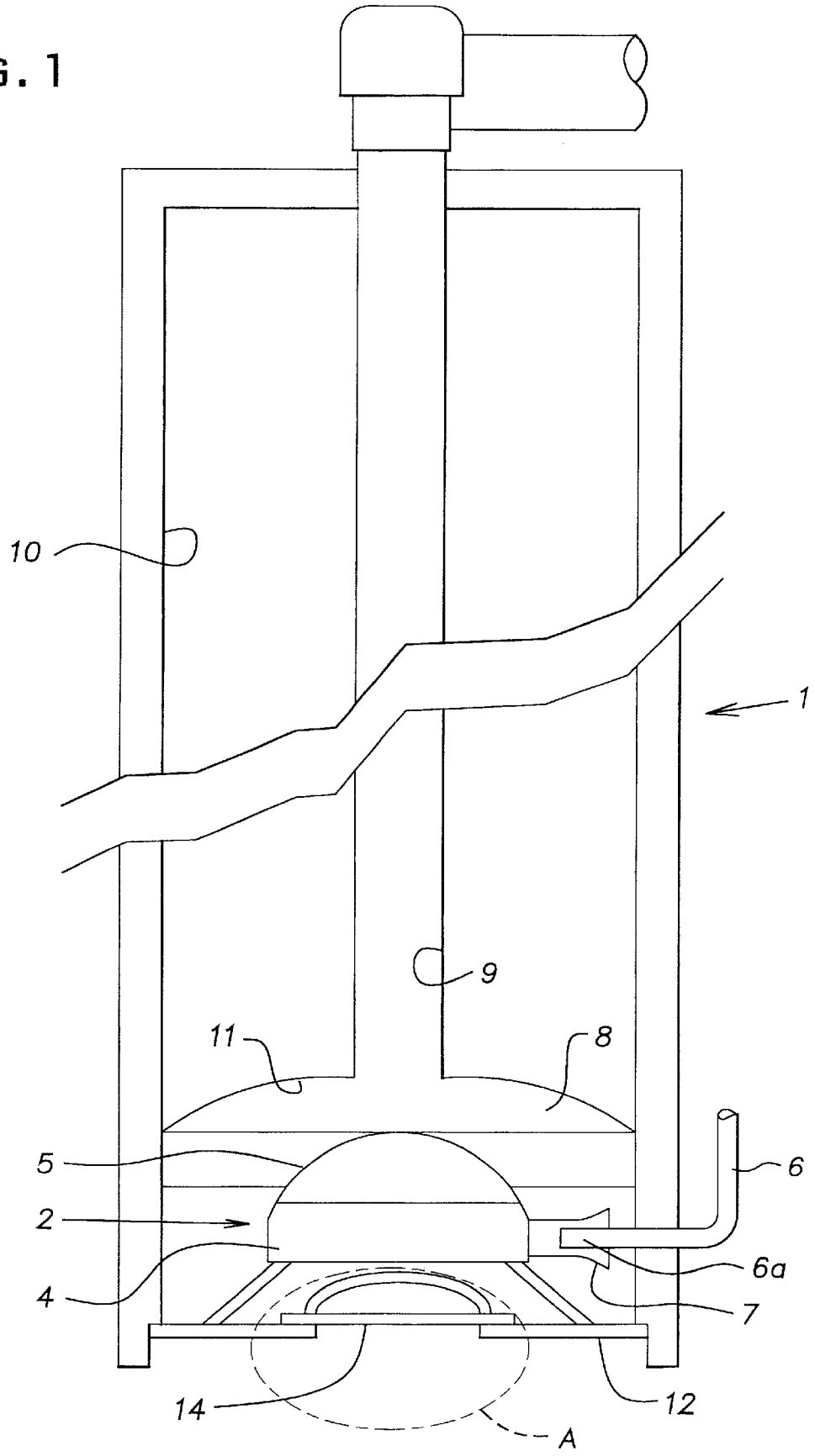
FIG. 1 is a schematic longitudinal sectional view of a water heater having a burner and a gas flow device according to the invention.

Referring to FIG. 1, heater 1 includes a gas-fired burner or combustion unit 2 having a combustion surface 5 located in a water heater 1 and positioned below a water tank or container 10. More particularly, the burner 2 is located within a substantially sealed combustion chamber 8 in the base of the water heater 1.

The combustion unit 2 includes a plenum chamber 4 positioned below the burner combustion surface 5 and an air/fuel mixing and delivery device comprising an air duct 7. The air duct 7 may be in the form of a venturi as shown or in the form of a cylindrical tube or pipe. The cross-sectional area of the air duct should be sufficiently large to minimize pressure flow losses relative to the subatmospheric pressure driving force above the combustion surface 5.

Gaseous fuel, such as natural gas, is provided to the burner 2 via fuel line 6. The fuel enters the air duct 7 from a nozzle 6a and aspirates or induces environmental ambient air to enter the plenum chamber 4 with the fuel. In this manner, the air duct 7 operates in response to the flow of fuel to aspirate and combine environmental air with the fuel to form a combustible air/fuel mixture which is delivered to the plenum chamber 4 at a plenum pressure. The air duct 7 is arranged to allow an excess of primary air to mix with the fuel in the plenum 4. The majority of the primary combustion air is provided by the driving force of the subatmospheric pressure maintained above the combustion surface 5.

Combustion chamber 8 is in fluid communication, via pores in the burner combustion surface 5, with the plenum chamber 4, which in turn is in fluid communication with the air duct 7. Air duct 7 provides at least partial mixing of the air and fuel, which is completed within the plenum chamber 4.

The heater 1 may be provided with a pilot light (not shown) or other conventional means to provide ignition at burner start-up. Further, a thermocouple (not shown) may be provided for regulation of a gas supply valve (not shown) in a known manner.

The burner combustion surface 5 is preferably made of wire mesh, and is more preferably made of inconel 601 wire mesh. Burner combustion surface 5 may also be made of other heat resistant porous materials, such as ceramics.

As indicated above, the burner combustion surface 5 is disposed within the substantially sealed combustion chamber 8. Combustion chamber 8 may enclose the burner element 2, or the burner element 2 may be attached to the bottom wall 12 of the combustion chamber, whereby burner combustion surface 5 constitutes a portion of the inner wall of chamber 8. Chamber 8 is sufficiently sealed to prevent entry into the combustion chamber 8 of secondary air in quantities which could adversely affect burner operation.

Flue stack 9 constitutes an opening to the environmental air. Thus, as used here in relation to combustion chambers, "sealed" or "closed" refers to minimizing entry of ambient air into the combustion chamber relative to the amount of primary or secondary air. "Sealed" or "substantially sealed" also refers to the condition that exists when the combustion gases within the combustion chamber 8 are not in fluid communication with the outside environment to a degree sufficient to adversely affect the combustion products and limitation of pollutants.

Combustion chamber 8 has an opening 13 preferably located in the lower wall 12 which is covered by a gas flow device such as flexible member or diaphragm 14 that is permeable to gas flow but restricts particulate flow into the combustion chamber 8. The gas flow device also provides pressure relief to suppress the low frequency resonance. The diaphragm 14 covering the opening 13 may be formed of a resilient deformable material such as a polymeric material, a woven structure or a combined woven and polymeric structure. Woven structures may include metallic, graphite, carbon or polymeric fibers such as KEVLAR. Suitable polymeric materials include butyl rubber, natural rubber, silicone rubber, vinyl polymers, urethane polymers, polyethylene polymers or fluoride polymers such as to polytetrafluoroethylene.

The resilient deformable material must meet the high temperature requirements of the combustion chamber 8, and can be evaluated using the following criteria: flexibility, low cost, high temperature rating, ease of manufacture, and durability. The criteria is not absolute and if the material that the diaphragm 14 is made from meets one or more of the criteria it may be suitable. Silicone rubber is used in the preferred embodiment because of its flexibility, relatively low cost, ease of manufacture (injection molding), and because it satisfies the high operating temperatures of the combustion chamber. The flexibility of the diaphragm of course is effected by the diameter of the opening 13 and the thickness of the diaphragm 14. A suitable thickness range is 0.1 to 0.3 mm.

The material used to form the diaphragm 14 and/or its construction may provide sufficient permeability per se to allow the desired intake of ambient air for purposes of combustion. On the other hand, sufficient permeability and gas flow may be provided by openings or apertures 15 (FIG. 2) extending through the diaphragm. As shown, the openings 15 extend through the thickness of the diaphragm and open to the opposed faces 14*a* and 14*b* of the diaphragm 14. The openings 15 should be no greater than about 1.6 mm in size. In order to filter or restrict particulate, the openings 15 may range in size from 1 mm to 3 mm.

The diaphragm 14 is adapted to vent gas through openings 15 and to move in response to variations in the pressure of the chamber. Accordingly, the diaphragm 14 may be considered to be both a volume change device and a venting device. The diaphragm 14 of the present invention adjusts the volume of the combustion chamber 8 in response to pressure fluctuations in the combustion chamber 8. The inward or outward contraction or expansion of the diaphragm causes the hot water tank to make less noise by suppressing or dampening pressure fluctuations that exist in the combustion chamber 8 upon burner start-up. The diaphragm 14 is shown in FIG. 2 in dotted line in an outwardly extended position and displaced away from the combustion chamber 8 as occurs during a high-pressure cycle. For a diaphragm having a diameter in the range of 20–30 cm, the axial travel of the center point of the diaphragm may be 1 to 5 cm in each direction.

The openings 15 are sized to restrict the passage of particulate "P" through the diaphragm 14. Accordingly, particulate is collected along the face 14*b* of the diaphragm 14 during intake of ambient air. The particulate P is periodically dislodged from the surface 14*b* upon movement of the diaphragm 14. The dislodgment of the particulate may occur due to the motion of the diaphragm 14 and/or the flow gas from the combustion chamber 8 through the openings 15. In addition, the remote surface 14*b* of the diaphragm 14 and/or the diaphragm itself should not tend to assume static charges that may attract or secure particulate. The particulate is separated from the diaphragm 14 and may fall to the room floor or be otherwise conveyed away by ambient air movement to a different location. In any event, the particulate is prevented from entering the combustion chamber 8 or collecting in excessive amounts that may interfere with proper combustion.

The effective exclusion of particulate from the combustion chamber 8 enables a flame trap 20 to be mounted safely over the opening 13 and downstream of the combustion air flow through the diaphragm 14. The flame trap 20 may comprise one of more layers of wire mesh arranged to define interstices sized to pass the gas or intake combustion air, but to prevent flame propagation through its thickness. The exclusion of the particulate by the diaphragm 14 prevents particulate from accumulating on the flame trap 20 or within the interstices thereof so as to effectively block intake air flow and possibly provide a flame conducting medium which could ignite flammable vapors outside of the combustion chamber 8.

The pressure relief device such as the membrane or diaphragm 14 can be retroactively fitted with a snap in design that would lead to the benefits of the present invention. The membrane or diaphragm may be provided with any convenient configuration, such as circular, square, rectangular or combination thereof.

Turning to the operation of the heater 1, as best shown in FIG. 1, flue stack 9 extends upwardly from an upper dome-shaped wall surface 11 of the combustion chamber 8 through the center of the water tank 10. The flue stack may extend above the water heater to increase the natural draft and further decrease the subatmospheric pressure in the combustion chamber 8. The dome-shaped upper wall 11 functions to guide the combustion products into the flue stack 9. Further, the domed-shaped upper wall 11 operates as a heat exchange surface since it is part of the water tank.

The domed-shaped upper wall 11 of the combustion chamber 8 is in direct heat exchange relationship with the water within the water heater and its concave, domed shape accommodates the upward flow of the combustion products from the combustion chamber 8 into an upwardly extending flue stack 9. The combustion chamber 8 and flue stack 9 are structured so that the natural draft results in the flow of the buoyant combustion products up through the flue stack 9 and produces a subatmospheric pressure (e.g. 0.015 inches water column) within the combustion chamber 8. This facilitates the flow of fuel and primary air through the burner and the combustion surface so that a given size burner operates at a higher loading than the same burner would operate if the combustion chamber 8 were maintained at atmospheric pressure. This permits the manufacture of a water heater of a given rating with a smaller size burner than would be possible if the combustion chamber were at atmospheric pressure.

Flue stack 9 may also contain baffle device (not shown) to improve efficiency of heat transfer from combustion gases to the water. The baffle should be designed to reduce frictional flow losses in the flue stack 9.

The burner may be operated at conditions which result in primarily convective heat transfer, e.g. 70% to 80% or more, and reduced emissions of pollutants. To that end, the combustion or flame temperature is maintained in the range of 600 to 900° C. by the use of excess primary combustion air. Generally, the excess air is in the range of from about 110% to about 200% in order to maintain the desired combustion temperatures. The combustion loading of the burner surface may range from about 500 to about 2,000 MJoules/$m^2$ hr. These operating conditions reduce the $NO_2$ emissions to less than about 5 ng/Joule and provide a $CO/CO_2$ ratio of less than about 0.003 discussed in assignee's U.S. Pat. No. 5,340,305. Accordingly, the outdoor ventilation of the flue products is not required. Such combustion temperatures also favor convective heating over radiant heating so that the burners provide primarily convective heat transfer. Heretofore, burners having combustion surfaces were operated at significantly higher temperatures to promote radiant heat transfer. The lower temperature operating conditions also increase the selection of suitable materials for the flexible member or membrane because this material must be able to withstand the temperatures that exist in various locations within the combustion chamber.

Figure 4:
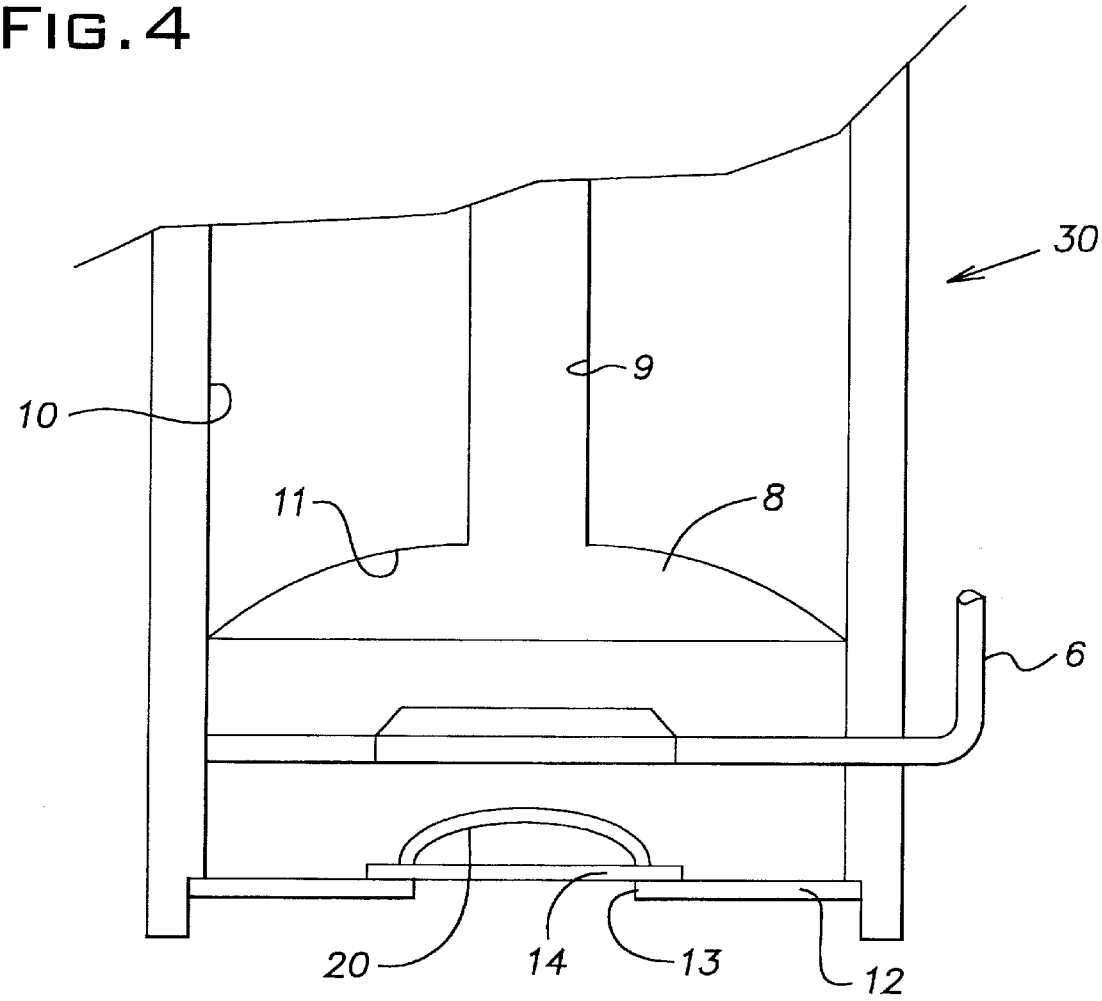
FIG. 4 is a fragmentary sectional view similar to FIG. 1 showing the gas flow device and flame trap used in a water heater having a blue flame burner.

The second embodiment of the present invention is shown in FIG. 4. This embodiment is similar to that described above and for convenience, similar elements are identified with the same number and elements that have been modified are indicated by a prime symbol (′). The same or similar elements operate in the manner discussed above.

The heater 30 has a combustion unit 31 comprising a blue flame burner positioned below the upper wall 11 of the combustion chamber 8. Once again, a pilot burner (not shown) and thermocouple (not shown) may be provided in a known manner. Gaseous fuel is delivered to the burner 31 through fuel line 6 with primary air and secondary air being drawn from the combustion chamber 8. The burner 31 combusts the fuel and air mixture to yield hot combustion products that rise through the flue stack 9 passing through the center of the water tank 10.

Ambient air is drawn into the combustion chamber 8 through the opening 13 in the lower wall 12. The flexible member or diaphragm 14 covers the opening 13 and, as described above, again allows passage of gas or ambient air to provide combustion air and filters particulate to prevent it from entering the combustion chamber. Accordingly, the flame trap 20 may be used effectively and safely to prevent flame propagation and ignition of flammable vapors remote of the combustion chamber.

Figure 5:
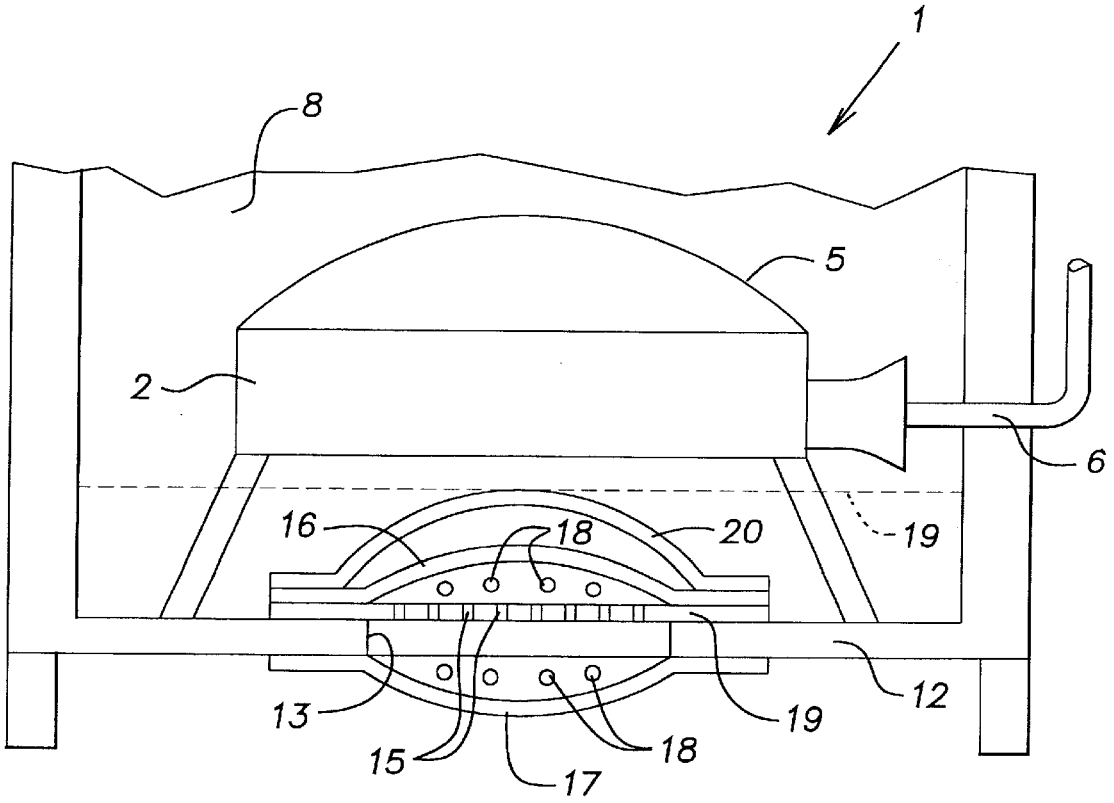
FIG. 5 is a fragmentary sectional view of the water heater of FIG. 1 modified in accordance with a further embodiment of the invention.

Referring to FIG. 5, a further embodiment of the present invention is shown. This embodiment is similar to those described above and for convenience similar elements are identified with the same number and operate in the same manner as described above. The burner 2 is mounted in the combustion chamber 8. The diaphragm 14 extends across the opening 13 in the lower wall of the combustion chamber 8 and the flame trap 20 is arranged to receive the ambient air entering the combustion chamber through the diaphragm 14.

In this embodiment, the diaphragm 14 is structurally supported by perforated protective covers 16 and 17 located at each side of the diaphragm. The perforated protective covers 16 and 17 have perforations 18 which allow the diaphragm to be in fluid communication with the combustion chamber 8 and the outside environment. Perforated covers 16 and 17 prevent unwanted displacement of the diaphragm 14.

In may be desirable in certain applications to position on the lower wall 12 insulation 19 (shown in dotted line) which may comprise, for example, a glass or mineral fiber batt. The insulation 19 provides multiple functions. The insulation 19 reduces the low frequency resonance by allowing passage of gas during pressure fluctuations and, if provided with an appropriate thickness, it operates as a flame trap. Of course, the insulation 19 also reduces heat loss through the wall 12. The placement of the insulation over the diaphragm 14, protective covers 16 and flame trap 20 also shields one or more of the latter from excessive heat. Such protection is particularly desirable in respect to the diaphragm 14, and enables the diaphragm to be formed of desirable materials which may not meet the above temperature criteria.

Furthermore, the positioning of the flexible membrane or diaphragm 14 on the lower wall 12 is very advantageous. First, combined with the insulation 19 the flexible diaphragm 14 reduces the noise to a point that it is barely, if at all, audible. Also, positioning of the flexible membrane or diaphragm 14 at the bottom of the tank on the lower wall 12 allows the membrane 14 to exist in the coolest place in the combustion chamber 8. The temperature directly below the plenum chamber 4 is not as hot as the rest of the chamber because of the buoyancy of the hot air/gas products and the positioning of the pressure relief device in the lower wall 12 prevents the diaphragm 14 from being damaged and provides for the longest life of the diaphragm 14.

Although preferred embodiments of this invention have been shown and described, it should be understood that various modifications and rearrangements of the parts may be resorted to without departing from the scope of the invention as disclosed and claimed herein.

What is claimed is:

1. In a gas water heater having a water container adapted to be heated by a gas burner surrounded by an enclosure, said water container being heated by combustion of a fuel by the gas burner, the improvement comprising a gas flow means to allow passage of gas and restrict passage of particulate into the enclosure, said gas flow means including a surface along which restricted particulate is collected, said surface being movable in response to combustion operation of said gas burner to dislodge collected particulate.

2. The improvement as set forth in claim 1, wherein said surface is movable in response to pressure fluctuations occurring in said enclosure during combustion operation of said gas burner.

3. The improvement as set forth in claim 2, wherein movement of said surface tends to inhibit said pressure fluctuations.

4. The improvement as set forth in claim 2, wherein said gas flow means comprises a flexible member having opposed first and second faces, and openings communicating between said faces.

5. The improvement as set forth in claim 4, wherein said second face of said flexible member provides said surface remote of said enclosure.

6. The improvement as set forth in claim 5, wherein said flexible member is a flexible membrane, said membrane comprising a polymer.

7. The improvement as set forth in claim 6, wherein said flexible membrane is formed of a polymer selected from the group consisting of silicones, synthetic and natural rubber polymers, vinyl polymers, urethane polymers, polyolefin polymers and fluoride polymers.

8. The improvement as set forth in claim 6, wherein said openings comprise apertures formed in said flexible membrane.

9. The improvement as set forth in claim 6, wherein said enclosure includes a wall having a wall opening covered by said flexible membrane.

10. The improvement as set forth in claim 2, wherein a flame trap is arranged to receive gas passing through said gas flow means.

11. The improvement as set forth in claim 2, wherein said gas includes at least one member selected from the group consisting of ambient air and flammable vapor from outside said enclosure, a flame trap is arranged to receive gas passing through said gas flow means, and said particulate includes at least one member selected from the group consisting of dust, lint and airborne household particles.

12. A gas-fired apparatus including a gas burner surrounded by an enclosure, supply means for delivering fuel to said gas burner for combustion, gas flow means to allow passage of gas including ambient air and restrict passage of particulate into the enclosure, said gas flow means including a surface along which restricted particulate is collected, said surface being movable in response to combustion operation of said gas burner to dislodge collected particulate.

13. The apparatus as set forth in claim 12, wherein said surface is movable in response to pressure fluctuations occurring in said enclosure during combustion operation of said gas burner.

14. The apparatus as set forth in claim 13, wherein movement of said surface tends to inhibit said pressure fluctuations.

15. The apparatus as set forth in claim 13, wherein said gas flow means comprises a flexible member having opposed first and second faces, and openings communicating between said faces.

16. The apparatus as set forth in claim 15, wherein said second face of said flexible member provides said surface remote of said enclosure.

17. The apparatus as set forth in claim 16, wherein said enclosure includes a wall having a wall opening covered by said surface.

18. The apparatus as set forth in claim 13, wherein said enclosure comprises a substantially sealed combustion chamber, and said supply means include a venturi to aspirate combustion air to said gas burner, and said gas flow means further includes pressure relief means for suppressing said pressure fluctuations in said combustion chamber.

19. The apparatus as set forth in claim 18, wherein said pressure relief means comprises a flexible member.

20. The apparatus as set forth in claim 19, wherein said flexible member is a polymeric membrane.

21. The apparatus of claim 12, wherein said enclosure includes a surrounding wall and gas flow means comprises a displaceable wall portion providing said surface movable in response to pressure variations in said combustion chamber.

22. The apparatus of claim 21, wherein said displaceable wall portion is reciprocally movable in response to pressure variations in said combustion chamber.

23. The apparatus of claim 22, wherein said displaceable wall portion comprises a flexible membrane.

24. The apparatus of claim 12, wherein said enclosure comprises a combustion chamber including a surrounding wall having an opening there through and said pressure relief means comprises a layer of porous material extending over said opening.

25. A gas-fired apparatus including a gas burner located in a substantially sealed combustion chamber vented to the atmosphere, said combustion chamber having an adjustable volume, pressure fluctuations tending to occur in said combustion chamber during combustion, and gas flow means to allow passage of gas including ambient air and restrict passage of particulate into said combustion chamber, said gas flow means also tending to inhibit said pressure fluctuations by adjusting said combustion chamber volume.

26. The apparatus as set forth in claim 25, wherein said gas flow means include surface means for collecting restricted particulate, and said surface means is movable in response to said pressure fluctuations to dislodge collected particulate remote of said combustion chamber.

27. The apparatus as set forth in claim 26, wherein said combustion chamber includes a wall having a displaceable wall portion having an exterior surface, and said surface means is said exterior surface of said displaceable wall portion.

28. A method of operating a heater including a gas burner surrounded by an enclosure, said enclosure having an opening means for intake of ambient air for combustion, comprising the steps of passing said ambient air through a gas flow means to allow passage of gas including ambient air and restrict passage of particulate into the enclosure, collecting restricted particulate along a surface of said gas flow means, and moving said surface in response to combustion operation of said gas burner to dislodge collected particulate from the surface.

29. The method of claim 28, wherein the step of moving said surface includes moving the surface in response to pressure fluctuations occurring in said enclosure during combustion operation of said gas burner.

30. The method of claim 29, wherein said pressure fluctuations move said surface with an oscillation rate of less than one second.

31. The method of claim 30, wherein said gas flow means comprises a flexible member having said surface extending along one side thereof, said surface extending across said enclosure opening means with said surface being remote of the enclosure and the step of moving said surface comprises reciprocally displacing said flexible member.

* * * * *